US006330780B1

(12) United States Patent
Shipway

(10) Patent No.: US 6,330,780 B1
(45) Date of Patent: Dec. 18, 2001

(54) APPARATUS AND METHOD FOR FILLING

(75) Inventor: Malcolm Shipway, Bristol (GB)

(73) Assignee: David S. Smith Packaging Limited (GB)

( * ) Notice: Subject to any disclaimer, the term of this patent is extended or adjusted under 35 U.S.C. 154(b) by 0 days.

(21) Appl. No.: 09/365,687

(22) Filed: Aug. 2, 1999

(30) Foreign Application Priority Data

Jul. 9, 1999 (GB) ..... 9916215

(51) Int. Cl.[7] ..... B65B 55/04
(52) U.S. Cl. ..... 53/426; 53/268
(58) Field of Search ..... 53/426, 268, 198, 53/381, 468

(56) References Cited

U.S. PATENT DOCUMENTS

| | | | | |
|---|---|---|---|---|
| 2,930,170 | * | 3/1960 | Holsman et al. | 53/426 |
| 3,393,491 | * | 7/1968 | Burton et al. | 53/468 |
| 4,283,901 | * | 8/1981 | Schieser | 53/426 |
| 4,494,363 | * | 1/1985 | Rica et al. | 53/426 |
| 4,510,737 | * | 4/1985 | Ellert | 53/468 |
| 4,519,184 | * | 5/1985 | Brunswick | 53/268 |
| 4,597,245 | * | 7/1986 | Parker | 53/468 |
| 4,916,885 | * | 4/1990 | Loliger | 53/468 |
| 4,972,652 | * | 11/1990 | Critchley et al. | 53/468 |
| 5,653,091 | * | 8/1997 | Stark | 53/426 |

FOREIGN PATENT DOCUMENTS

| | | |
|---|---|---|
| 088735 | 9/1983 | (EP) . |
| 280871 | 9/1988 | (EP) . |
| 395933 | 11/1990 | (EP) . |
| 911260 | 4/1999 | (EP) . |
| WO 8900952 | 2/1989 | (WO) . |

* cited by examiner

*Primary Examiner*—Peter Vo
*Assistant Examiner*—Chukwurah Nathaniel
(74) *Attorney, Agent, or Firm*—Blakely Sokoloff Taylor & Zafman

(57) ABSTRACT

The invention relates to apparatus for filling a container such as a plastic bag with product. The apparatus comprises a fill valve and a chamber formed as an integral unit, in which during a filling operation a container with a cap is in place is offered up to and placed in the bag by gripping devices or jaws, the cap is removed by a capper mechanism the bag is filled with product, and the cap is replaced, all the flow paths and surfaces being sterilised by steam during the filling operation.

15 Claims, 5 Drawing Sheets

APPARATUS AND METHOD FOR FILLING

Figure 1:
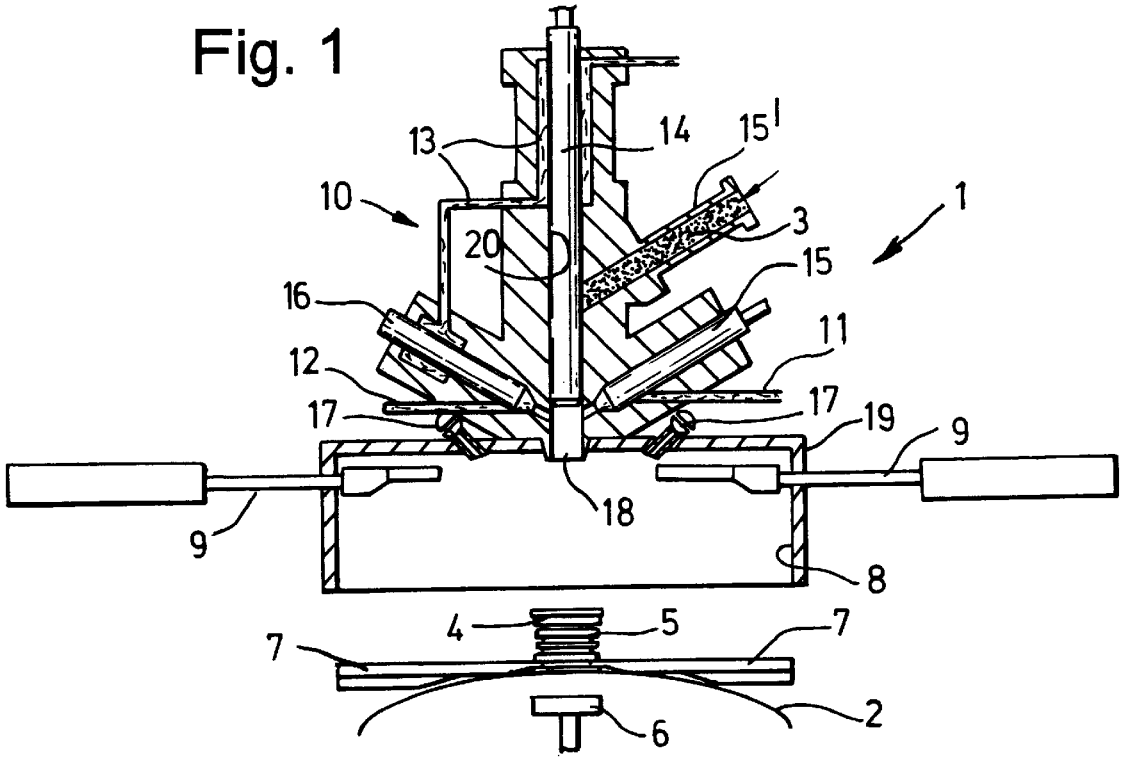

The invention relates to an apparatus and method for filling, and particularly to the filling of a container such as a plastic bag, with contents and in a sterile manner.

It is often necessary that a container such as a plastic bag is filled with a product which can be a food or drink product. In such circumstances, it is usually necessary or desirable that the bag is filled and closed with a closure such as a cap under sterile conditions.

Fill valves as part of a filling apparatus are used, and these have a facility for maintaining the product flow path therethrough sterile, during filling and before and after, but often such valves cannot apply a closure to the filled bag. This therefore requires expensive additional apparatus and steps otherwise the initially sterilised bag and the product may become contaminated.

It is accordingly an object of the invention to seek to mitigate this disadvantage.

According to a first aspect of the invention there is provided apparatus for sterilising a container for product during filling therof, characterised by means having a part for dispensing product in a sterile manner and a part adapted for sterilising a container and closure thereof during filling.

The part may comprise a fill valve for filling product into the container.

The fill valve may comprise means to sterilise flow paths therethrough and may be characterised by an inlet for product.

There may be means to control flow through the means which may comprise respectively flow paths for sterilising medium.

There may be reciprocable plungers each operable in a respective flow path to obturate the flow path.

Further, there may be a reciprocable plunger operable to open and close a flow path of product and which is in a flow path for sterilising medium.

The flow paths and plungers may be connectible with a source of sterilising medium whereby product can flow the fill valve through and in contact with sterile surfaces of the flow paths and plungers.

The part may comprise a chamber for receiving the container.

There may be means for holding the container during a filling operation.

The chamber may comprise a box-like container which has an end open in a direction away from a filling orifice thereof.

The means may comprise gripping devices which are adapted to grip a part of the container and to close off the open end of the chamber to provide a sterile interior when sterilising medium is admitted thereto, and the chamber may be characterised by at least one sterilising inlet.

The gripping devices may comprise oppositely facing jaws having profiled parts which are complementary in shape to a gland of the container.

The apparatus may include a capper mechanism in the chamber.

The capper mechanism may comprise means to remove a cap from the container for filling, and to replace the cap after filling.

The capper mechanism may be characterised by opposed reciprocable piston and cylinder arrangements.

There may be means to press a wall of a container against the underside of the gland.

There may be a source of sterilising medium comprising steam.

According to a second aspect of the invention there is provided a method of sterilising a container for containing product when a closure is applied to a filling opening thereof, characterised by providing means to apply a closure to an orifice of the container, and means to sterilise the closure and adjacent container parts during filling of the container and application of the closure to the container.

The method may suitably comprise the steps of presenting a container with a cap to a filling valve, sterilising the container and cap, removing the cap, filling the container with product through the filling valve, replacing the cap, and removing the filled container from the filling valve with the cap in place.

The container may be a plastic bag, and the closure may be a cap applied to the orifice, which may be an opening through which product is filled into the bag.

The sterilising means may comprise a steam chamber.

Apparatus and method for sterilising a container and cap during an operating cycle to fill the container with product in a sterile manner are hereinafter described with reference to the following nine figures, which respectively show each of nine sequential steps in a filling and sterilising cycle.

Referring to the drawings there is shown apparatus 1 and method for filling a container such as a plastic bag 2 with product 3 such as food powder or a liquid such as wine and for applying a cap 4 to an orifice, which is an orifice, opening or aperture through which product is filled or charged into the bag, and through which it may be dispensed subsequently. The opening comprises a gland or boss 5, which is closed with the cap 4, which is also sterilised during the filling operational cycle.

The apparatus 1 includes a pressing device such as a bag pad 6 for holding the bag 2 to the gland 5 when necessary, and retractable gripping devices or jaws 7 for holding the gland, which is ribbed as shown. The gripping devices or jaws 7 are oppositely facing and have free ends complementary in shape to grip the gland 5. The devices or jaws 7 are mounted on a mechanism for securing and lowering them, and for moving them into and out of contact with the gland. There is also a chamber 8 in which the bag 2 with the gland 5 can be received when raised thereinto by the jaws 7 during the filling cycle, the chamber 8 having a retractable capper mechanism 9.

Above, as viewed, the chamber 8 there is a fill valve 10 which has means 11, 12 to sterilise various path or flow ways therethrough, the sterilising medium in the embodiment being steam. There is a path 13 providing a steam barrier round a reciprocable plunger 14, an inlet 15' for the product 3, the steam inlet 11 and exhaust 12 being controlled by means in the form of plungers 15, 16 to control flow of steam to the chamber 8 and bag 2. The fill valve 10 is a single unit which serves both to sterilise the flow paths therethrough for product, and the bag into which the product is to be charged.

An operational cycle to fill a bag with product and to close it with a cap is hereinafter described.

The first step in the cycle is shown in FIG. 1 . The valve or filling valve 10 is at rest with the plunger 14 in a downward position (as viewed), a steam barrier 13 being in place as shown and plungers 15, 16 forming the steam control means being extended to close off the steam inlet 11 and exhaust 12. The capper mechanism is retracted too, and the bag 2, with a cap 4 in place on the gland 5 is loaded into and held by the jaws 7 as shown, exteriorly of the chamber 8. The bag pad 6 is retracted.

Figure 2:
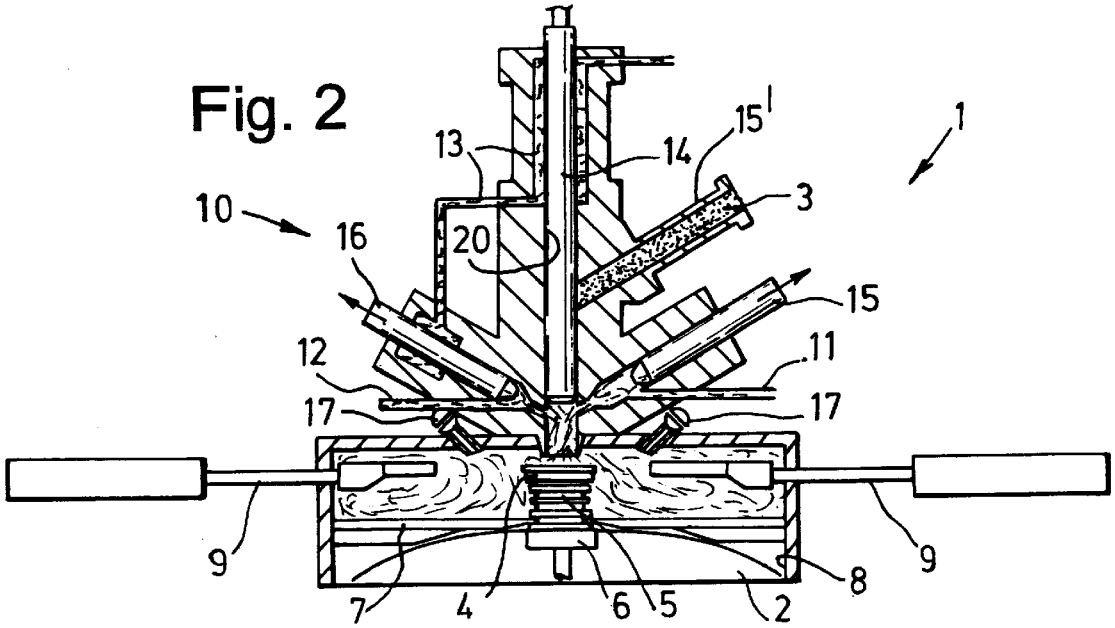

The second step in the cycle is shown in FIG. 2. The jaws 7 have been raised and have thus lifted the bag 2 up into the chamber 8 and the bag pad 6 has been raised to ensure that a wall of the bag 2 and of the gland 5 are held together.

The valve plunger 14 is still extended, while the plungers 15, 16 are retracted to allow passage of steam through the apparatus 1 from the steam inlet 11 to the exhaust 12, and into the chamber 8 above the bag 2 via inlets or bleed lines 17 so that the bag 2, cap 4, gland 5 and jaws 7 and capper mechanism 9 are sterilised. The steam barrier 13 is in place, as it is through the whole cycle.

Figure 3:
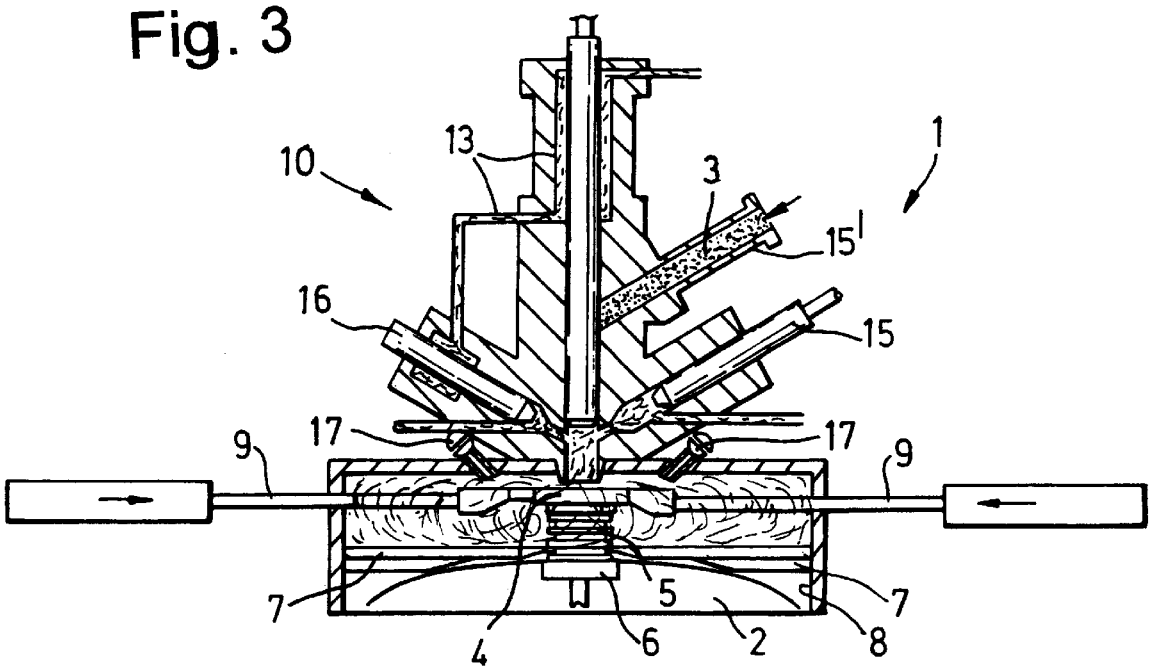

FIG. 3 shows a third step in the cycle, during which the capper mechanism is extended, in the steam-filled chamber. The capper mechanism is now around the cap 4, which, with the mechanism, is sterilised by the steam.

Figure 4:
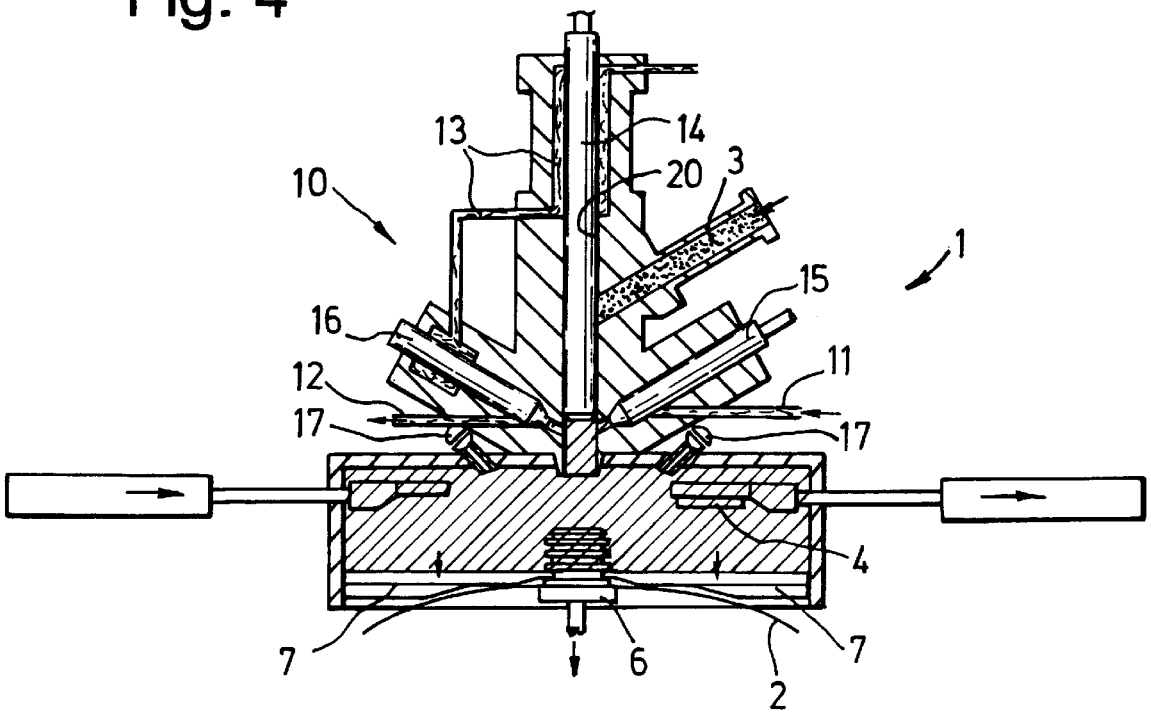

Next, the fourth step in the cycle takes place, as shown in FIG. 4. The jaws 7 lower the bag 2, the capper mechanism 9 is retracted after having removed and retained the cap 4 before lowering of the bag 2, and steam to the chamber 8 is cut off.

Figure 5:
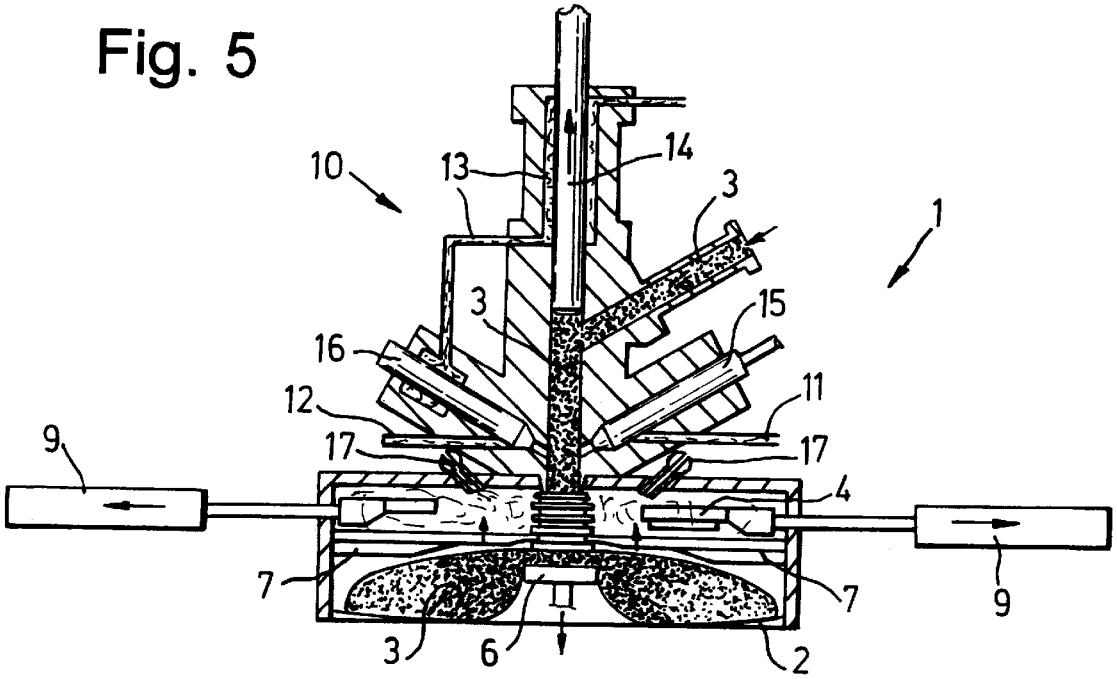

Then, as shown in FIG. 5, step five of the cycle takes place. The jaws 7 raise the bag 2, so that the free end, or top as viewed, of the gland, abuts the underside of a filling orifice 18 in the top wall 19 of the chamber 8 which chamber has an open end, downwardly as viewed, being open in a direction away from the filling orifice 18. The bag pad 4 is retracted to open a flow path through the gland 5 into the bag 2 interior via the orifice 18, the valve plunger 14 being retracted to open a flow path for product 3. Product thus flows down a cylinder 20 from 15', (which cylinder 20 is a housing for the plunger 14), into the bag 2. Essentially, the fill valve 10 is open.

Figure 6:
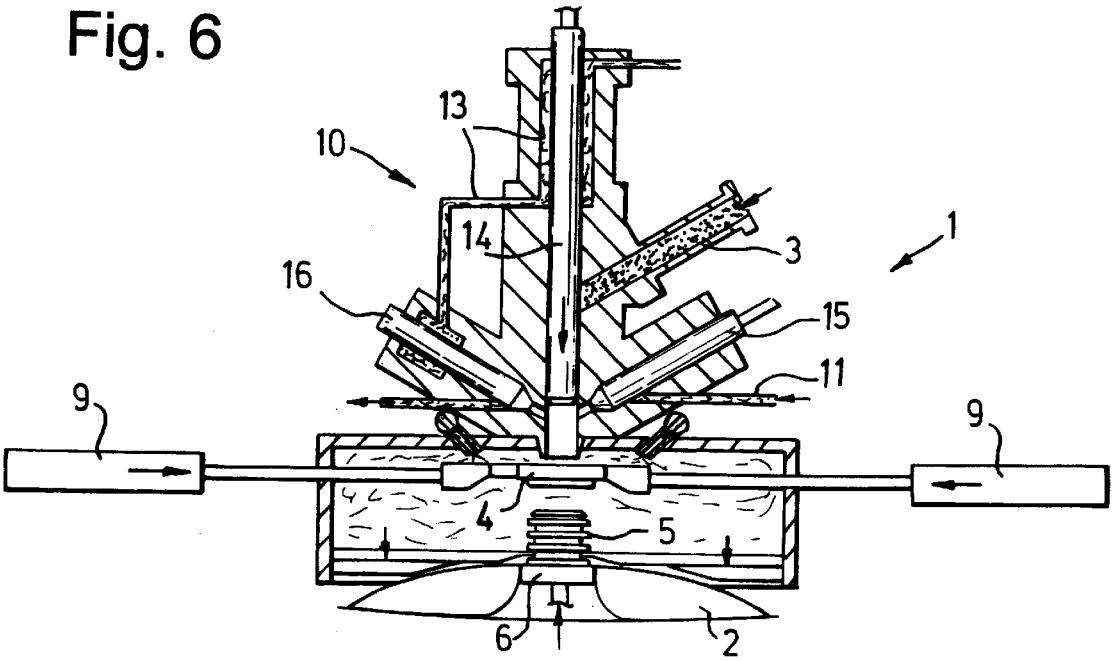

Then, in the sixth step of the cycle as shown in FIG. 6, the fill valve 10 is closed. This comprises extending the plunger 14 to cut off the product flow path and raising the bag pad 6 to close off the lower end, interior, of the gland 5 with a part of the bag wall. The jaws 7 are lowered to provide space above the gland 5, which is therefore withdrawn from the filling orifice 18, and the capper mechanism 9 is actuated to extend the arms thereof to replace the cap over the upper, open, end of the gland 5, steam flow being cut off to the chamber 8 by the plungers 15, 16.

Figure 7:
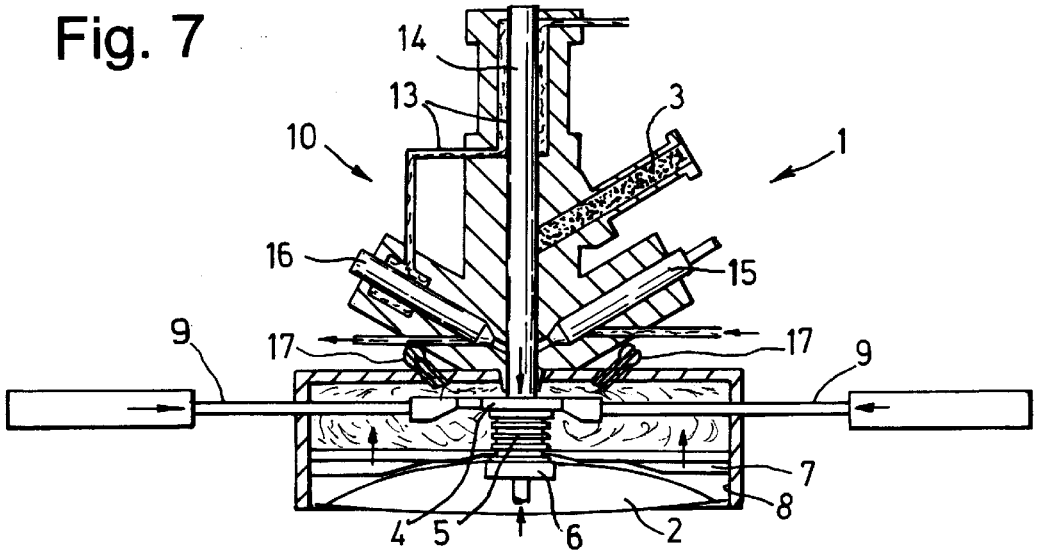

As shown in FIG. 7, in the seventh step of the filling cycle, the jaws 7 are activated by being raised and thereby to raise the bag 2 against the cap 4. The fill valve 14 plunger is extended further to engage the upper side of the cap 4 which is thus re-secured to the gland 5 and released from the capper mechanism 9. The bag is essentially recapped.

Figure 8:
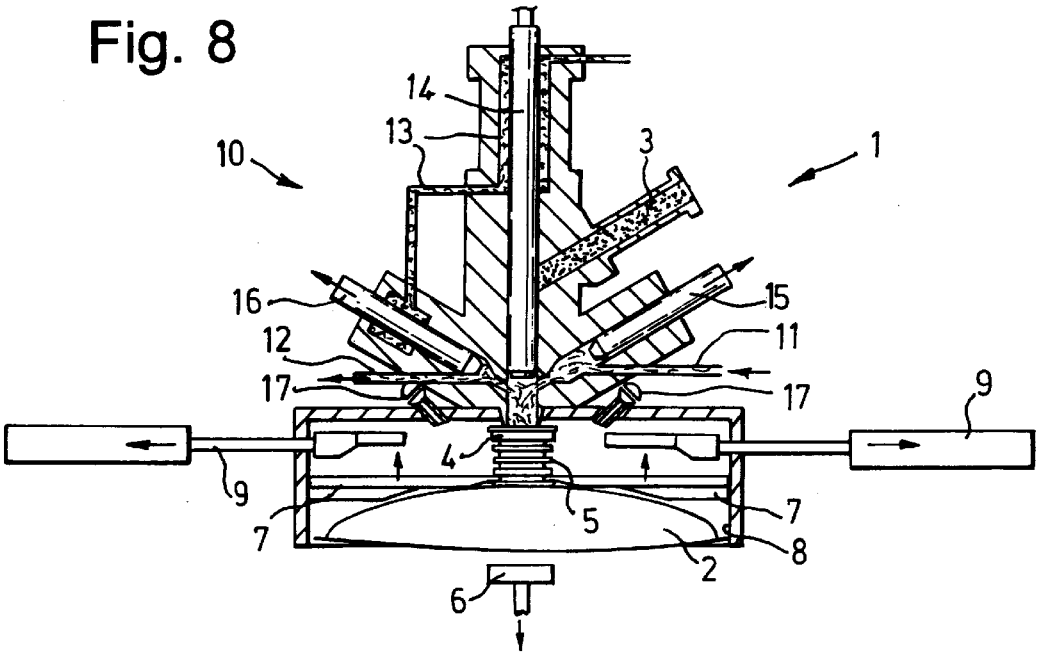

The next step, the eighth in the cycle, is shown in FIG. 8. The capper mechanism 9 is withdrawn into a rest or park position, the cap 4 is against the underside of the upper wall of the chamber under the filling orifice 18 so that it can be said that the fill valve 10 seats on the cap. The plungers 14, 15, 16 are retracted, to allow sterilising steam to sterilise the filling orifice 18 and the underside of the ends of the plungers 14, 15, 16. The bag pad 6 is retracted, and there is no steam, which is at low pressure, in the chamber 8 as the bleed lines 17 are obturated.

Figure 9:
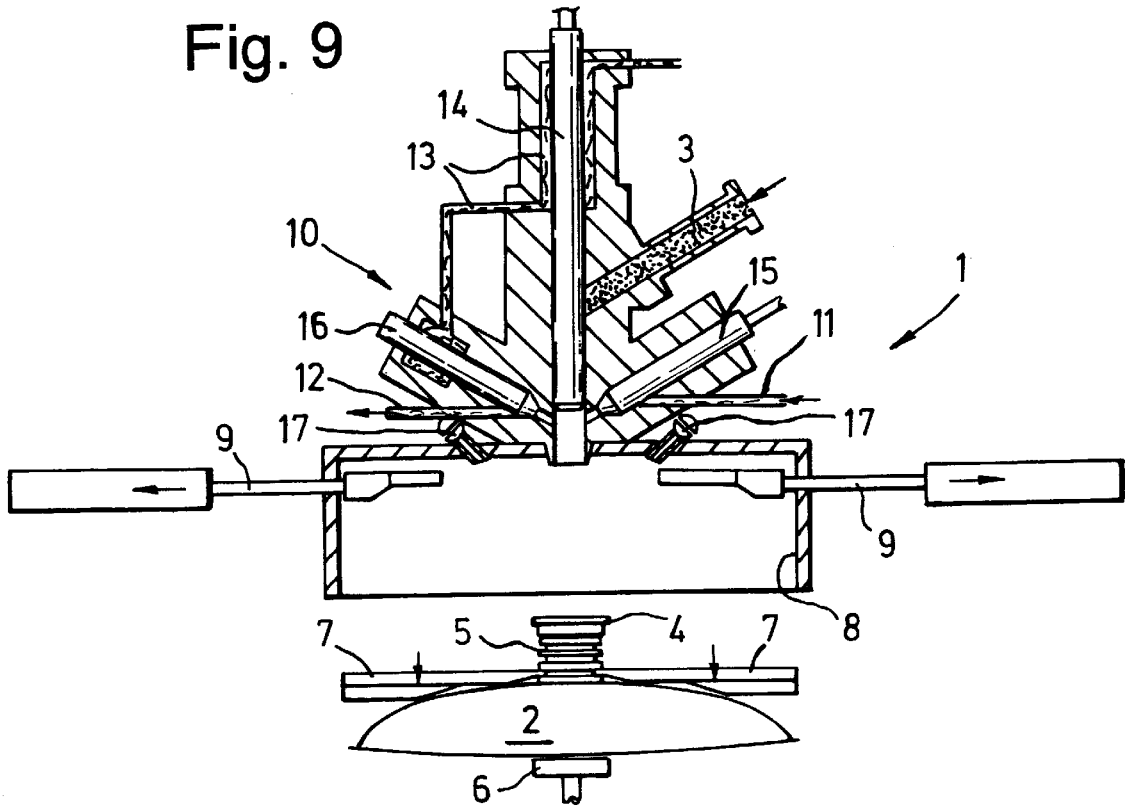

Finally, in FIG. 9 as shown, in the ninth step of the cycle, the jaws 7 are fully retracted (lowered) so that the bag 2, filled, capped and sterilised is removed from the chamber 8 for subsequent handling. The steam inlet and exhaust are also closed off the by plungers 15, 16 so that the fill valve 10 of the apparatus is at rest.

Thus the apparatus 1 and method hereinbefore described with reference to the accompanying drawings allow a bag 2 to be filled or charged with product 3, closed, and sterilised in an automatic cycle of operations, the gripping devices or jaws 7 serving not only to grip the bag, and raise and lower it, but also to close off the bottom, as viewed, of the chamber 8 so that steam is always contained in the chamber during a cycle of operations.

I claim:

1. Apparatus for sterilizing a container for product during filling thereof, comprising:

(i) means having a first part for dispensing product in a sterile manner; and (ii) a second part adapted for sterilizing a container and for applying a closure to an orifice thereof during filling, the apparatus further comprising at least one flow path for a sterilizing medium, and at least one reciprocable plunger to control the flow of the sterilizing medium through said at least one flow path.

2. Apparatus as defined in claim 1, wherein the first part comprises a fill valve for filling product into a container.

3. Apparatus as defined in claim 2, wherein the fill valve comprises means to sterilize a flow path therethrough and an inlet for product.

4. Apparatus as defined in claim 3, wherein there is a reciprocable plunger operable to open and close a flow path of product and which is in the flow path for the sterilizing medium.

5. Apparatus as defined in claim 3, wherein product can flow through said fill valve through and be in contact with sterile surfaces of the at least one flow path and plunger.

6. Apparatus as defined in claim 1, wherein the second part comprises a chamber for receiving the container.

7. Apparatus as defined in claim 6; wherein there is means for holding the container during a filling operation.

8. Apparatus as defined in claim 6, wherein said chamber comprises a container which has an end open in a direction away from a filling orifice thereof.

9. Apparatus as defined in claim 6, wherein said chamber comprises a container which has an end open in a direction away from a filling orifice thereof, wherein there is means comprising gripping devices which are adapted to grip a part of the container and to close off the open end of the chamber to provide a sterile interior when the sterilizing medium is admitted thereto, and wherein the chamber includes a sterilizing inlet.

10. Apparatus as defined in claim 9, wherein the gripping devices comprise oppositely facing jaws having profiled parts which are complementary in shape to a gland of the container.

11. Apparatus as defined in claim 6, wherein there is a capper mechanism in the chamber.

12. Apparatus as defined in claim 11, wherein the capper mechanism comprises means to remove a cap from the container for filling, and to replace the cap after filling.

13. Apparatus as defined in claim 11, wherein the capper mechanism comprises opposed reciprocable piston and cylinder arrangements.

14. Apparatus as defined in claim 6, wherein there is means to press a wall of a container against an underside of the filling orifice.

15. Apparatus as defined in claim 1, where there is a source of sterilizing medium comprising steam.

* * * * *